US010758794B1

(12) United States Patent
Day

(10) Patent No.: US 10,758,794 B1
(45) **Date of Patent: *Sep. 1, 2020**

(54) GOLF CLUB HEAD

(71) Applicant: Cobra Golf Incorporated, Carlsbad, CA (US)

(72) Inventor: Cameron J. Day, Vista, CA (US)

(73) Assignee: COBRA GOLF CORPORATION, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/363,232

(22) Filed: Mar. 25, 2019

Related U.S. Application Data

(63) Continuation of application No. 15/486,983, filed on Apr. 13, 2017, now Pat. No. 10,279,229.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01)

(58) Field of Classification Search
USPC ..... 473/324–350
See application file for complete search history.

(56) References Cited

U.S. PATENT DOCUMENTS 3,199,872 A * 8/1965 Taylor ..... A63B 53/0487 473/309
4,181,306 A * 1/1980 Jepson ..... A63B 53/04 473/342
4,569,524 A * 2/1986 Quijano ..... A63B 53/0487 473/342
5,049,165 A 9/1991 Tselesin
5,340,107 A * 8/1994 Baker ..... A63B 53/0487 273/DIG. 23
5,749,793 A * 5/1998 Lucetti ..... A63B 53/0487 473/324
5,842,935 A * 12/1998 Nelson ..... A63B 53/0487 473/342
6,086,484 A * 7/2000 Uebelhor ..... A63B 53/0487 473/251
6,792,934 B2 * 9/2004 Benyovits ..... B23D 59/02 125/12
8,088,489 B2 * 1/2012 Oh ..... C04B 26/02 428/411.1
9,132,324 B2 9/2015 Fernandez
10,279,229 B1 * 5/2019 Day ..... A63B 53/0487
2002/0016220 A1 * 2/2002 Franco ..... A63B 53/0487 473/340

(Continued)

FOREIGN PATENT DOCUMENTS

JP 11114114 A * 4/1999
JP 3055886 B2 6/2000
JP 2001137399 A * 5/2001

OTHER PUBLICATIONS

Machine translation obtained from Espacenet on Mar. 7, 2017, of JP 3055886 B2 (11 pages).

*Primary Examiner* — Alvin A Hunter
(74) *Attorney, Agent, or Firm* — Quarles & Brady LLP

(57) ABSTRACT

A golf club head with a multi-material construction in which a portion of the club head is a first material such as engineered stone or concrete and a second portion of the club head is a second material such as a metal, thermoplastic, or a composite.

13 Claims, 9 Drawing Sheets

(56) References Cited

U.S. PATENT DOCUMENTS

| | | | | |
|---|---|---|---|---|
| 2006/0009306 | A1* | 1/2006 | Bauer | A63B 53/04 473/324 |
| 2011/0281666 | A1* | 11/2011 | Hair | A63B 53/0487 473/340 |
| 2013/0095953 | A1* | 4/2013 | Hotaling | A63B 53/04 473/332 |
| 2016/0001139 | A1 | 1/2016 | Fernandez | |

* cited by examiner

GOLF CLUB HEAD

TECHNICAL FIELD

The disclosure relates to a golf club head with a multi-material construction, with a portion of the club head comprising a material such as engineered stone.

BACKGROUND

People enjoy golf because they get to spend time outdoors in a beautiful setting, because they get to master a challenging skill, and because it can be a rich social experience. However, even though no two golf courses are the same, and no two rounds of golf will ever be the same, there is one constant that appears throughout games of golf. Satisfaction comes from performing well. Many golfers are familiar with the frustration and discontent that they suffer when they don't play well. The frustration or annoyance of not playing well is only aggravated when the poor outcomes are attributable to equipment that gives inconsistent results.

Some have theorized that putting may be the least reliable or consistent part of the golfer's game. Nevertheless, putting is a significant part of golf. For example, it has been estimated that in 2012, the entire PGA Tour averaged 30 putts out of 71 strokes per round. This means that even for the best players, putting makes up about 40% of all shots. Because putting is such a large part of a golfer's score, the inconsistency in putting experiences is particularly vexatious. What may further aggravate the annoyance and frustration of many golfers is the difficulty in identifying why putting performance is so much less reliable and less consistent that drives and fairway shots.

Some have speculated that aesthetic appearance of a putter is one of its most important attributes. See U.S. Pat. No. 9,132,324. However, it is unlikely that mere aesthetic changes will improve the reliability and consistency of a putter's performance.

SUMMARY

The invention relates to a golf club head with a multi-material construction, in which a portion of the club head uses a first material such as engineered stone or concrete and a second portion of the club head uses a second material such as a metal, thermoplastic, or a composite. Using a material such as engineered stone gives the club head a mass and a mass distribution that results in remarkably consistent and predictable swing characteristics. The golf club head may be a putter head and it may have a multi-material construction. For example, a first, inner portion of the putter head may be made substantially of a first, stone-like material such as engineered stone or concrete. A second, outer portion of the putter head may be made of a metal or composite material and may provide a hosel as well as an outer shell or surface of the putter head. The first material e.g., the engineered stone or concrete preferably has a density between about 2 and about 3 g/cm$^3$, while the second material may have a significantly different density (for example, may be stainless steel with a density between about 7 and about 8 g/cm$^3$). Use of the first material allows the putter head to have an increased volume and to decrease mass per volume for that material, allowing for mass to be redistributed to other portions of the club head. Such a putter has excellent playing characteristics including a smooth and uniform swing, controlled and predictable energy transfer to the golf ball, forgiveness to off-center hits, and excellent uniformity and consistency of motion of the golf ball after impact by the putter.

In certain aspects, the invention provides a golf club head with a multi-material construction. At least a first portion of the club head is made of a first material such as engineered stone or concrete and another portion of the head is made of a second material such as a metal, thermoplastic, or composite. The first material preferably has a density between about 2 and about 3 g/cm$^3$, The first material may be, for example, engineered stone or concrete. Preferably, the golf club head is a head for a putter. In some embodiment, the first portion of the club head provides a substantial portion of the club head such as, for example, between about 20 and 80 percent of the volume of the golf club head. In certain embodiments, between about 50 and 80 percent of the club head by weight and volume is provided by the first material.

In some embodiments, the first portion of the club head comprises, as the first material, engineered stone. Engineered stone includes composite materials made of crushed stone bound together by an adhesive such as a polymer resin. Some embodiments of engineered stone include 90-95% quartz based on weight with the rest being resin.

In certain embodiments, the first portion of the club head comprises, as the first material, concrete. Where the first portion of the club head includes concrete, the concrete preferably is composed of up to about 60% cement mixed with a material such as sand, gravel, pozzolan, or aggregate.

In embodiments of the invention, the engineered stone or concrete portion of the club head includes a reinforcing material disposed within the second material. The reinforcing material may include fibers such as, for example, steel fibers, composite fibers, or plastic fibers.

In certain embodiments, the reinforcing material includes bars of a material such as metal, thermoplastic, or a composite, to provide the engineered stone or concrete with a rebar structure. The bars of material may exhibit an ordered structure such as a lattice, cage, or frame distributed through the engineered stone or concrete to add strength and structure. The reinforcing material may be made reinforcing bars of steel or some other metal. The reinforcing material may include fibers, such as composite fibers, organic fibers, or fiberglass. For example, in some embodiments, the engineered stone or concrete is substantially reinforced by a network of composite carbon fibers. In certain embodiments, the reinforcing material comprises reclaimed waste such as shredded plastic. In concrete embodiments, the reinforcing material comprises sand and/or gravel. Any suitable material may be used in the reinforcing material including, for example, steel, stainless steel, aggregate, resin, carbon fiber, organic fibers, composite, urethane, a thermoplastic, etc.

A related aspect of the invention provides a golf club. The golf club includes a shaft with proximal and distal ends, a grip on the proximal end of the shaft, and a golf club head attached to the distal end of the shaft. The golf club head has a multi-material structure in which a first portion of the club head is made of a first material such as engineered stone or concrete and another portion of the head is made of a second material such as a metal, thermoplastic, or composite. The first material preferably has a density between about 2 and about 3 g/cm3. The first material (e.g., the engineered stone or concrete) may include one or more reinforcing materials such as a structured cage-like or lattice-like insert, fibers, bars, reclaimed waste, or sand and/or gravel. Most preferably, the golf club is a putter, although other club types are within the scope of the invention such as, for example, wedges and irons. Where the first material includes engineered stone, that material may include e.g., crushed stone bound together by an adhesive such as a polymer resin or, in some embodiments, cement. In a preferred embodiment, the engineered stone includes a mixture of about 93% stone aggregates and about 7% polyester resin by weight (e.g., about 66% quartz and about 34% resin by volume). Where the first material includes concrete, that material may include less than about 60% Portland cement with the balance being a material such as pozzolan.

DETAILED DESCRIPTION

Figure 1:
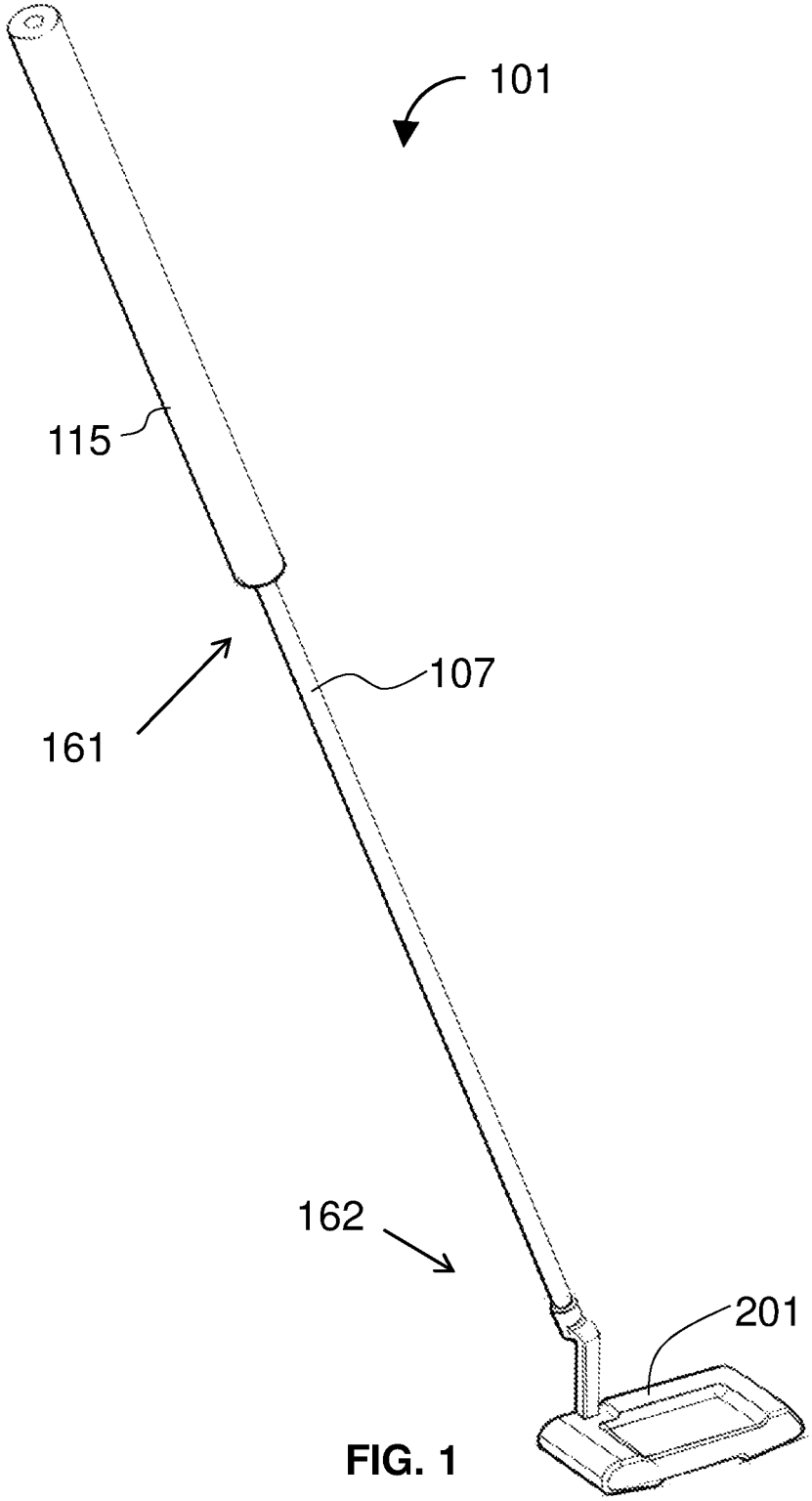
FIG. 1 shows a golf club with a club head of the invention.

FIG. 1 shows a golf club 101 that includes a shaft 107 with a proximal end 161 and a distal end 162. A grip 115 is connected on the proximal end 161 of the shaft 107, and a golf club head 201 is attached to the distal end 162 of the shaft 107. The golf club head 201 has a multi-material structure in which a first portion of the club head is made of a first material such as engineered stone or concrete and another portion of the head is made of a second material such as a metal, thermoplastic, or composite.

Figure 2:
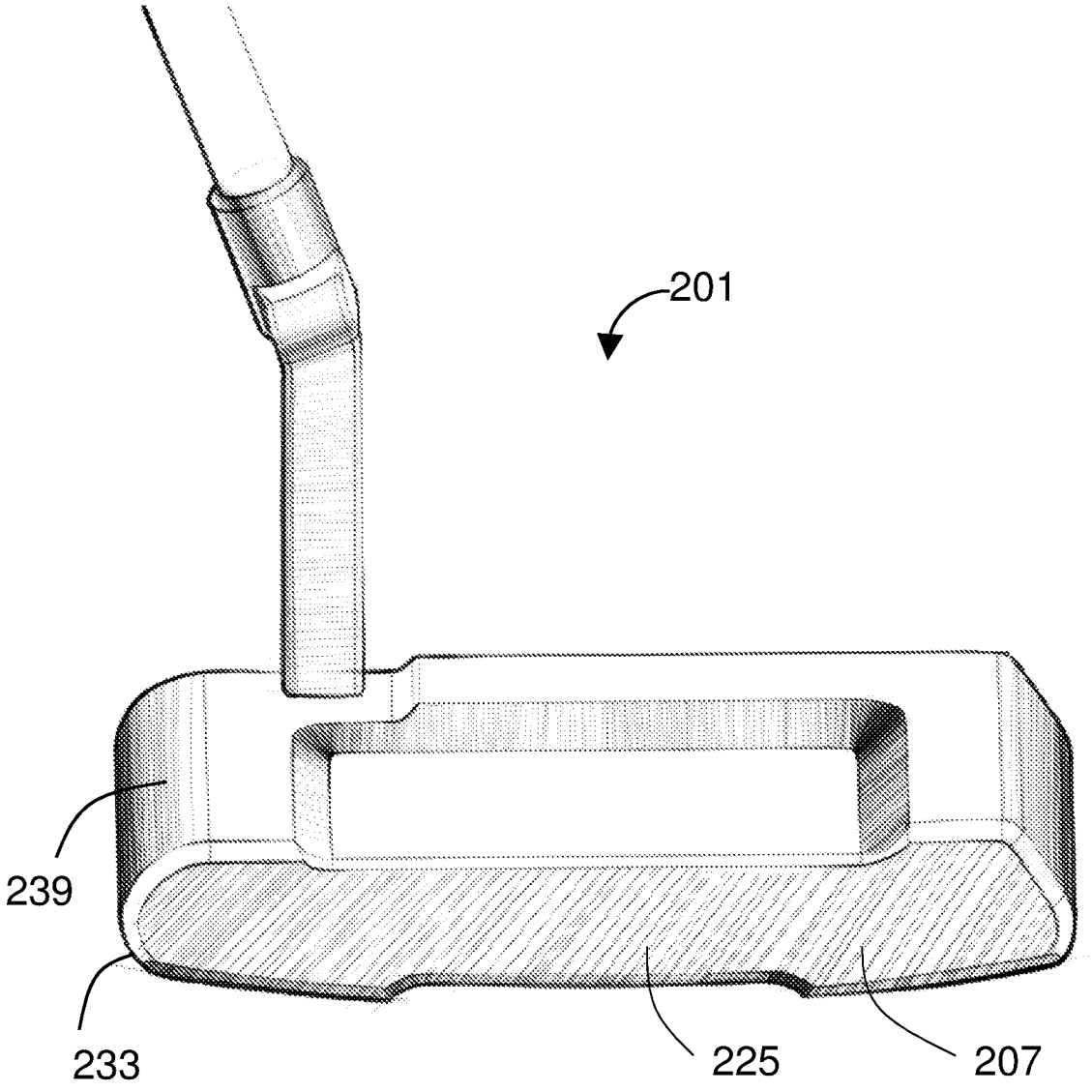
FIG. 2 shows the club head.

FIG. 2 shows the club head 201. The club head 201 has a multi-material construction in which a first portion 207 of the club head 201 is made of a first material 225 such as engineered stone or concrete and another portion 233 of the head is made of a second material 239 such as a metal, thermoplastic, or composite.

In the depicted embodiment, the club head 201 is for a putter, and the first portion 207 of the club head 207 is a substantial portion of (e.g., >50% of the volume of) the club head 201.

In some embodiments, the first portion 207 of the club head 201 includes, as the first material 225, engineered stone. The engineered stone may include composite materials made of crushed stone bound together by an adhesive, (most commonly polymer resin, with some versions using cement mix). Stones that are used in producing engineered stone include marble and quartz. Some embodiments of engineered stone include 90-95% quartz based on weight; with the rest being a mix of resin, glass, dyes, or other material. Engineered stone may have colors, binders, resins and other small ingredients included for color and consistency. Engineered stone is stronger that other materials and relatively easy to shape.

In certain embodiments, the first portion 207 of the club head 201 includes, as the first material 225, concrete. Where the first portion 207 of the club head 201 includes concrete, the concrete preferably is composed of up to about 60% cement mixed with a material such as sand, gravel, pozzolan, or aggregate. Any suitable cement, may be used and preferably the cement includes calcium oxide. For example, the cement may be Portland cement. In some embodiments, the cement comprises between about 60 and 66 percent by weight CaO and between about 18 and 23 percent by weight SiO2. The first portion is composed of concrete that includes up to about 60% of the cement with the balance being, e.g., pozzolan. Additionally or alternatively, the concrete may include other materials such as fly ash, ground granulated blast furnace slag, or silica fume. Preferably, the cement is distributed substantially uniformly throughout the concrete portion.

In the depicted embodiments, the first material 225 (e.g., engineered stone or concrete) preferably has a first density between about 2 and about 3 g/cm$^3$. The second portion 233 of the club head 201 is provided by a second material 239, which may include a second density that is different than the first density. For example, where the second material 239 is stainless steel, the second material may have a second density between about 7 and about 8 g/cm$^3$.

By including engineered stone or concrete as the first material, the club head may have a mass distribution that favors heel and toe-biasing to increase moment of inertia about a vertical axis when the club head is at address. Additionally, the first material (e.g., engineered stone or concrete) may have very low compression in response to compressive stress, which may provide very favorable playing feel especially for putts. The properties give the club head a mass, mass distribution, and feel that result in remarkably consistent and predictable swing characteristics. The multi-material club head with the described first material exhibits remarkable playing characteristics including a smooth and uniform swing, controlled and predictable energy transfer to the golf ball, forgiveness to off-center hits, and excellent uniformity and consistency of motion of the golf ball after impact by the putter.

Additionally, a multi-material club head 201 with the first material 225 (e.g., engineered stone or concrete) is characterized by durability and strength such that the club head 201 resists chipping, fracturing, or cleavage. Such strength is theorized to be provided by engineered stone and can be enhanced in concrete by the particular composition. It is reasoned that concrete with less than about 60% cement may exhibit the desired resistance to cleavage or chipping.

In a preferred embodiment, the concrete is about equal parts cement and pozzolan, optionally with at least one additional reinforcing material such as fibers or bars or material scrap. Pozzolan is essentially a silicate mineral material that lightens and strengthens concretes. When added to a concrete, pozzolan make the material more durable, improves tensile properties, decreases density, improves molding detail, and makes the material more sustainable. A pozzolan is a siliceous or alumino-siliceous material that, in finely divided form and in the presence of moisture, chemically reacts with the calcium hydroxide released by the hydration of Portland cement to form calcium silicate hydrate and other cementitious compounds. Natural pozzolans are less expensive than concrete and their use does not contribute additional pollution to the environment. Cement with a high proportion of pozzolan (e.g., 40/60, 50/50, or 60/40), optionally with a reinforcing material, will be stronger then cement alone or cement with only a low amount of such a material.

In the engineered stone embodiments, the engineered stone may include crushed stone bound together by an adhesive such as a polymer resin or, in some embodiments, cement. In a preferred embodiment, the engineered stone includes a mixture of at least about 85% stone and at least about 5% resin (e.g., 85/5 balance reinforcing material or 93/7).

In concrete embodiments, the concrete may include less than about 60% cement and at least about 40% pozzolan. Optionally, the concrete may further include one or more of fly ash, ground granulated blast furnace slag, and silica fume.

Using concrete or engineered stone, the material may be formed (e.g., by cold molding) into a desired shape for inclusion as a component of a golf club. In certain embodiments, the concrete or engineered stone is formed into a club head. For example, for a club head with a multi-material construction in which a first portion of the club head made of a first material is held or disposed within a second portion of the club head, the first material may be cold-molded into the second portion of the club head.

Figure 3:
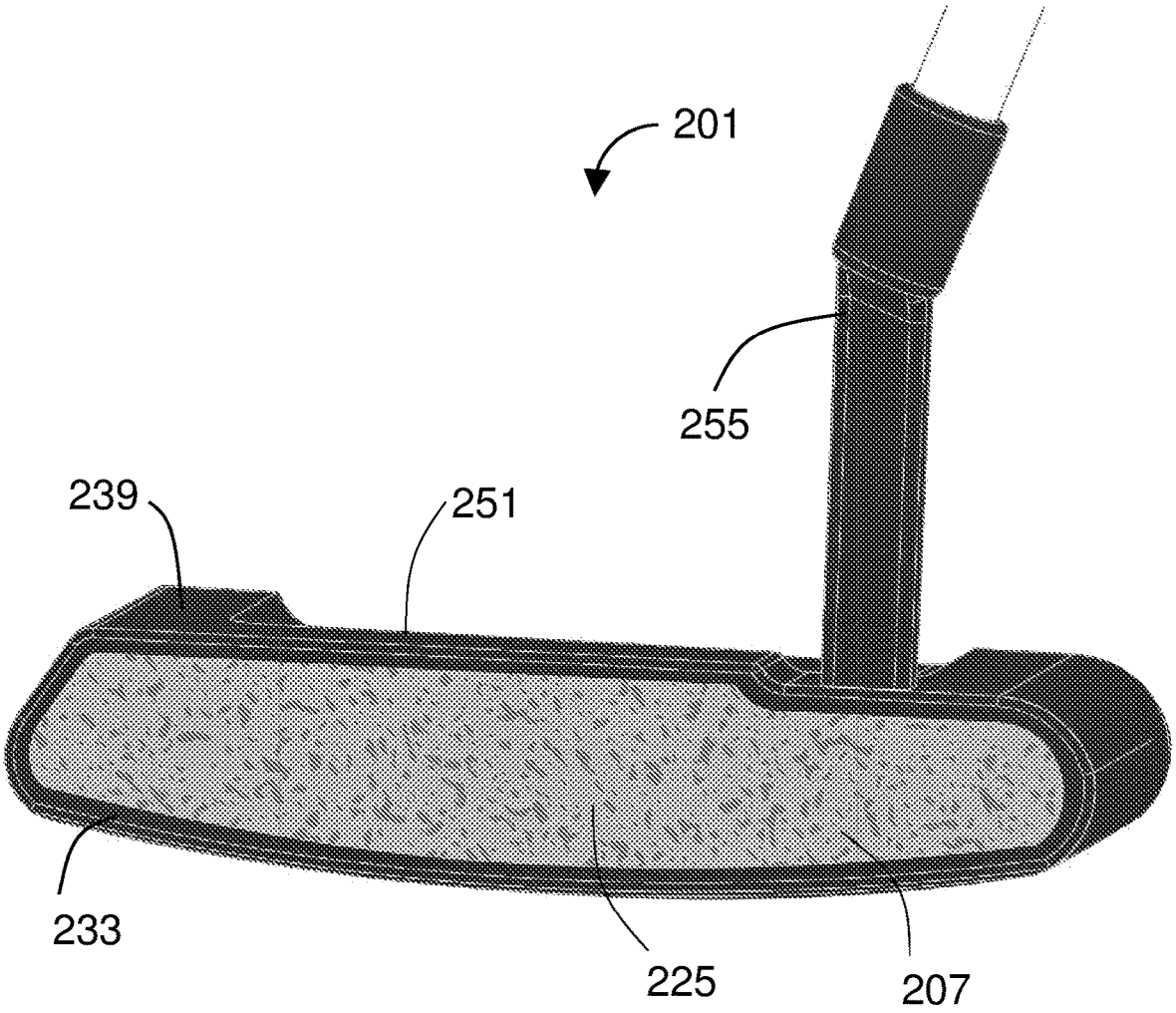
FIG. 3 shows a front view of the club head.

FIG. 3 shows a front view of the club head 201 in which the club head 201 is made by molding the first material 225 into a second portion 233 of the club head 201. Thus the first material 225 (e.g., engineered stone or concrete) is distributed with the second portion 233 of the club head. The second portion 233 of the club head preferably comprises a second material 239. The second portion 233 may be, for example, a cast steel or Ti body member 251, optionally with a hosel 255 extending therefrom for attachment to a shaft.

In the depicted embodiment, the first material 225 provides a ball-striking face of the putter head 201. It may be found that the first material 225 (engineered stone or concrete) exhibits excellent resistance to compression, giving the putter very good playing feel.

Figure 4:
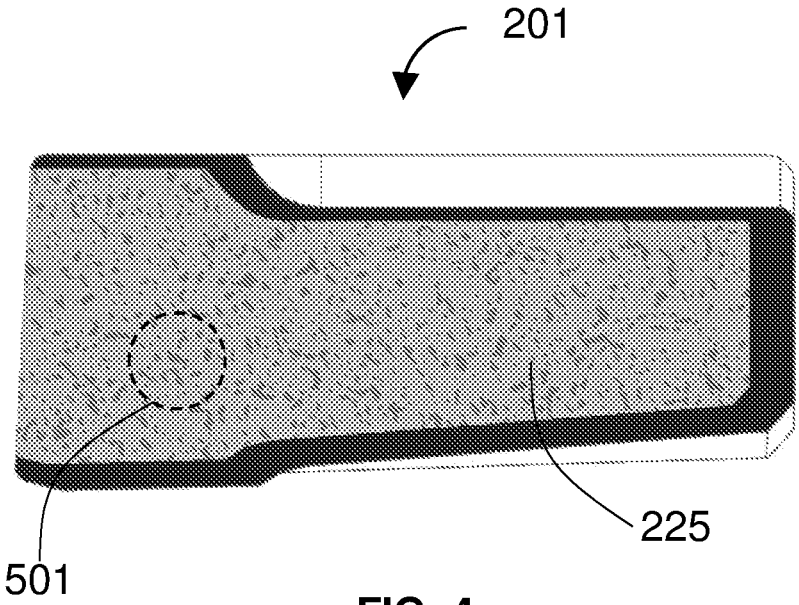
FIG. 4 shows a cross sectional-view through the club head.

FIG. 4 shows a cross sectional-view through the club head 201 to illustrate the substantially uniform composition of the first material 225 (engineered stone or concrete) according to certain embodiments.

Figure 5:
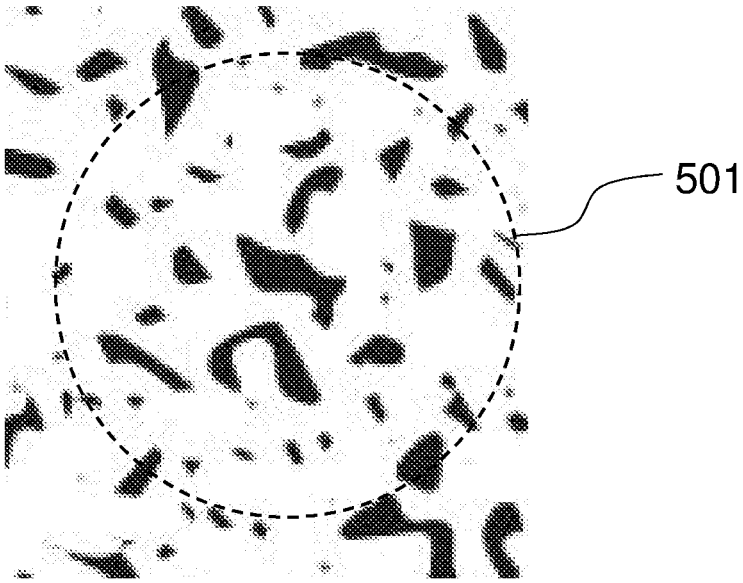
FIG. 5 is a close up view of a first material of the club head.
Figure 6:
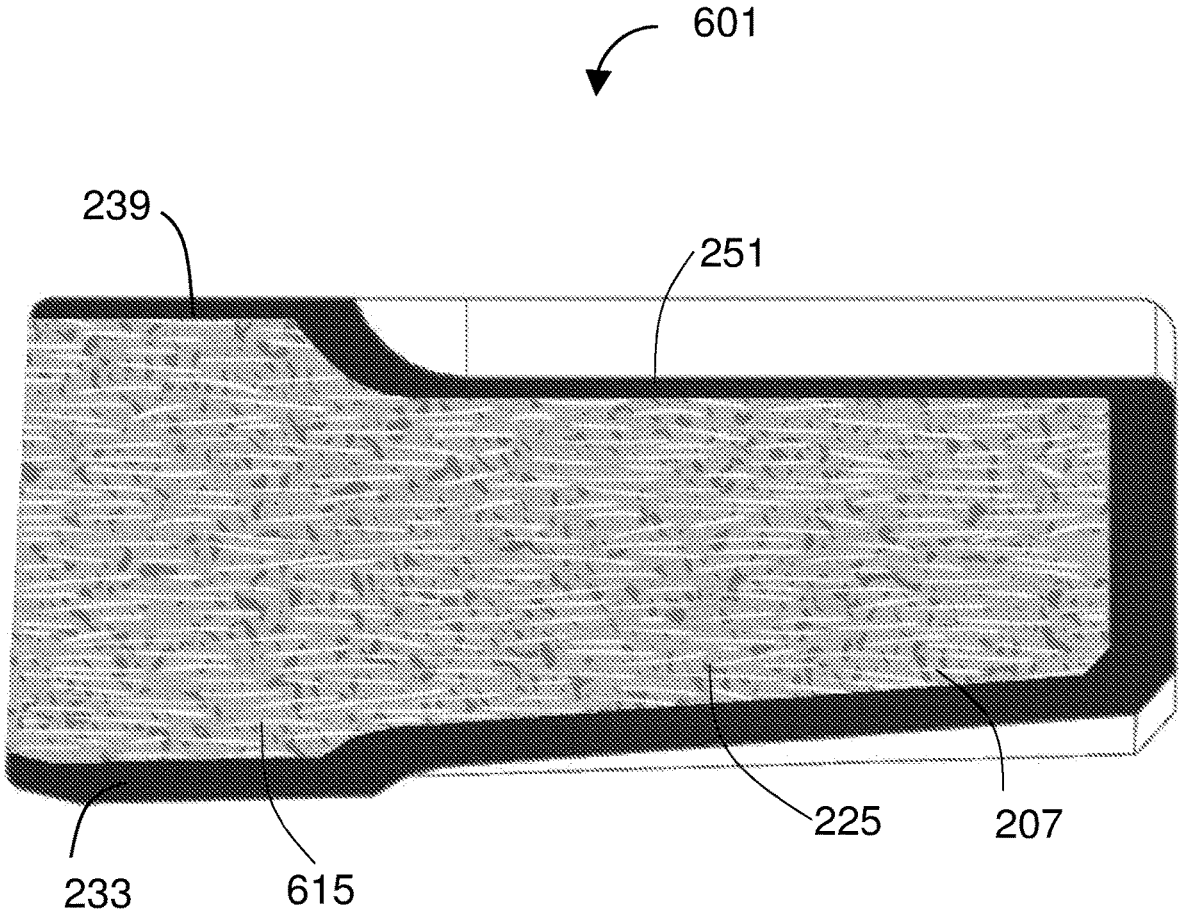
FIG. 6 is a cross sectional-view through a fiber-reinforced club head.

FIG. 5 is a close up view of area 501 shown in FIG. 4 to illustrate the composition of the first material 225. As shown in FIGS. 4 & 5, the first material 225 may be a substantially homogenous volume of engineered stone (e.g., about 93% quartz fragments bound together by an adhesive such as resin) or concrete (e.g., up to about 60% cement mixed with a material such as pozzolan). In other embodiments, the first material 225 of the club head 201 may include a reinforcing material disposed therein. Any suitable reinforcing material may be included such as, for example, fibers, bars of material, reclaimed waste, or sand and/or gravel FIG. 6 shows a cross sectional-view through a fiber-reinforced club head 601. The club head 601 includes the first material 225 disposed within a body member 251. The first material 225 includes fibers 615 such as steel fibers, composite fibers, or plastic fibers. In some embodiments, the fibers 615 are carbon fibers.

Figure 7:
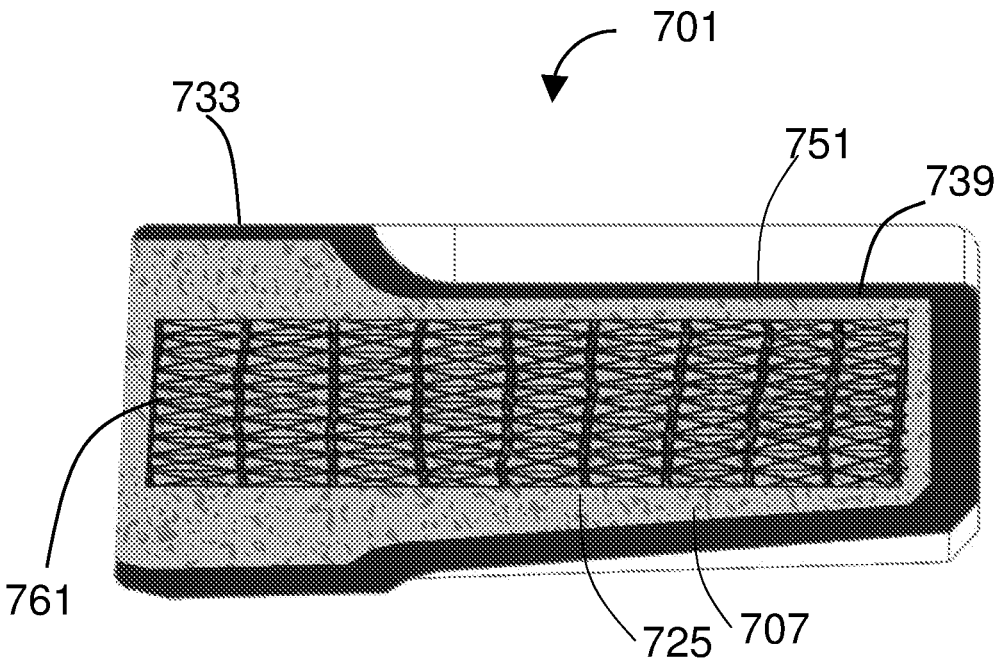
FIG. 7 shows a club head with a mesh-like insert defined by a lattice of struts.

FIG. 7 illustrates another embodiment of a club head 701 with a multi-material construction in which a first material 725 of the club head includes a mesh-like or lattice-like insert framework 761. The insert framework 761 is defined by a lattice of struts. Specifically, the golf club head 701 has a multi-material construction. At least a first portion 707 of the club head 701 is made of a first material 725 such as engineered stone or concrete and another portion 733 of the head is made of a second material 739 such as a metal, thermoplastic, or composite. A mesh-like or lattice-like insert framework 761 is disposed within the first portion 707. The first material 725 preferably has a density between about 2 and about 3 g/cm$^3$. The first material 725 may be, for example, engineered stone or concrete. Preferably, the golf club head 701 is a head for a putter. The second portion 733 may be, for example, a cast steel or Ti body member 751, optionally with a hosel extending therefrom for attachment to a shaft. The mesh-like or lattice-like insert framework 761 may be composed of a network of bars or fibers made of steel, plastic, or other such material. The mesh-like or lattice-like insert framework 761 exhibits an ordered structure such as a cage or frame distributed through the engineered stone or concrete to add strength and structure.

Figure 8:
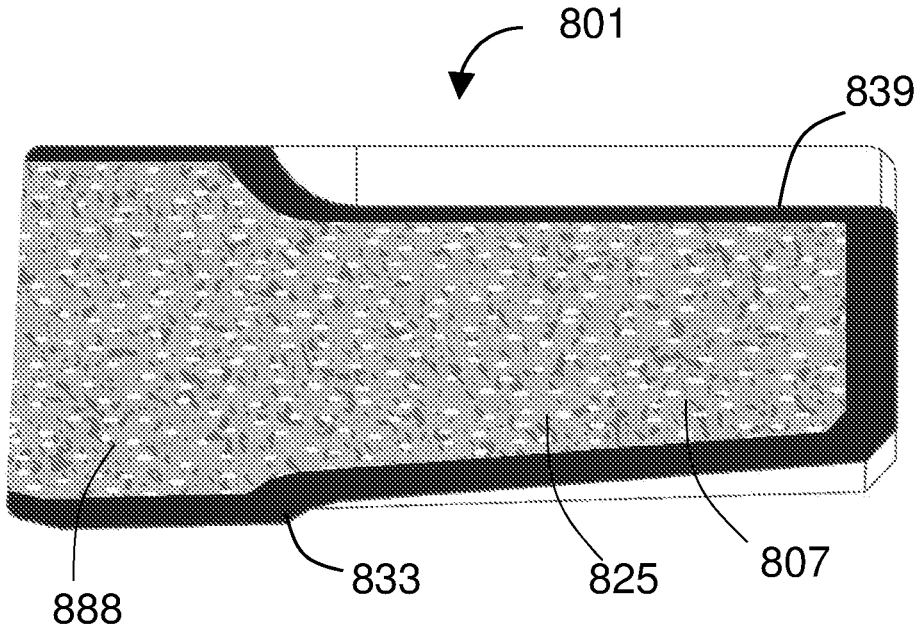
FIG. 8 shows an embodiment of a golf club head.

FIG. 8 shows an embodiment of a golf club head 801 with a multi-material construction in which at least a first portion 807 of the club head 801 is made of a first material 825 such as engineered stone or concrete and another portion 833 of the head is made of a second material 839 such as a metal, thermoplastic, or composite. The first material 825 may include a fragmented or fibrous material 888 such as reclaimed waste. Any suitable reclaimed waste may be included. For example, in some embodiments, the reclaimed waste comprises shredded plastic. For example, plastic bottles from municipal recycling may be obtained, washed, shredded, and cold-molded into the club head 801.

Given that concrete and engineered stone allow for cold molding, it may be found to be easy to include inserts, powders, etc., of materials with unlike densities to tune a mass distribution of a concrete or engineered stone club head. For example, concrete may be added to the mold in layers, and each layer may be impregnated with a different average volume of Tungsten powder. The layer(s) with a high amount of Tungsten powder will bias the club head CG position in the finished club head. Many experienced golfers may prefer a CG in a putter that is higher than would be provided by a putter head of uniform density.

For a putter, a higher CG may be found to provide optimal hitting characteristics in terms of ball spin and travel. To raise the CG in a concrete club head, the club head can be molded in layers wherein—in a sole towards crown description—one or more of the higher layers, towards the crown, is impregnated with a generous amount of Tungsten powder.

Additionally or alternatively, the club head can include weight inserts or lightweight inserts (e.g., an insert of material with a lower density than that of the surrounding concrete or engineered stone; e.g., a lightweight plastic insert near a sole can raise a CG; a lightweight plastic insert near the center of the club head can "free up mass" allowing corresponding weight slugs in the heel or toe portions to raise the club head MOI).

Figure 9:
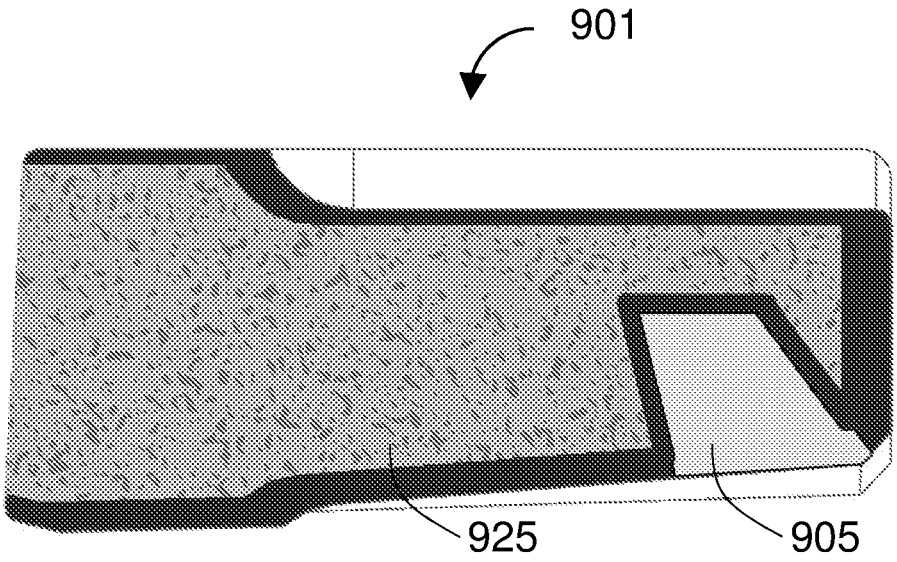
FIG. 9 shows a weighted club head.

FIG. 9 shows a weighted club head 901. The club head 901 includes a first material 925 (engineered stone or concrete) and includes at least one weight insert 905—here depicted as being near the sole and towards an aft-portion of the club head 901.

The concrete or engineered stone component of a club head need not be the entirety of the club head. Preferably, the concrete or engineered stone component is between about 30 and 80 percent of the volume of the golf club head. It may be useful to form the concrete or engineered stone component along with one or more additional components to provide the complete, finished club head. Thus a club head of the invention may have a multi-component construction in which a first component comprises predominantly concrete or engineered stone component and is coupled to a second component to form the club head.

Figure 10:
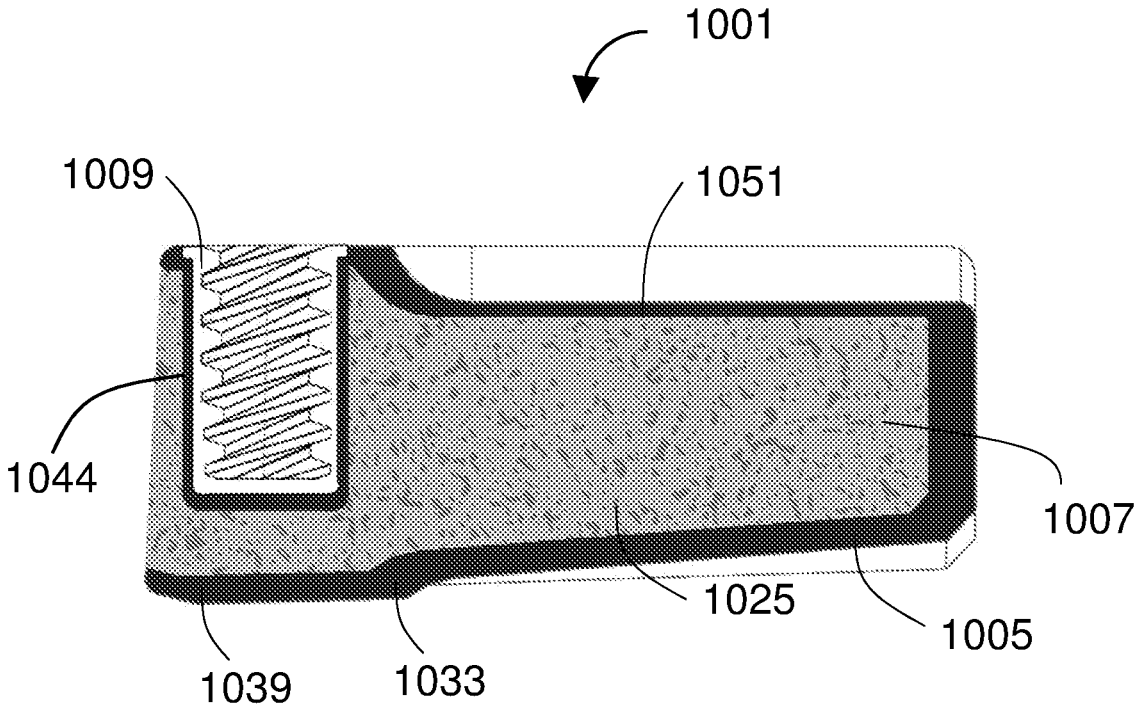
FIG. 10 shows a multi-component club head.

FIG. 10 shows a multi-component club head 1001. The club head 1001 has a multi-material construction in which a first portion 1007 of the club head 1001 is made of a first material 1025 such as engineered stone or concrete and another portion 1033 of the head 1001 is made of a second material 1039 such as a metal, thermoplastic, or composite. Here, the second portion 1039 is depicted as a molded or cast body member 1051 having the first portion 1007 disposed therein. The second portion may be, for example, a cast titanium piece or may be made out of a composite material such as carbon fiber. As depicted, the second portion 1033 further includes a recess 1044 with a threaded insert 1009 inserted therein. Such a construction allows for the threaded attachment of a shaft or for threaded coupling of weight inserts, light-weight inserts, or other attachments, such as electronic devices or other functional features.

Embodiments of the invention provide a club head that includes a component that is made substantially of concrete or engineered stone.

An embodiment provides a putter in which the head has a multi-material construction in which one component is made predominantly of concrete or engineered stone. Such a putter may be found to have remarkable playing characteristics including a smooth and uniform swing, controlled and predictable energy transfer to the golf ball, forgiveness to off-center hits, and excellent uniformity and consistency of motion of the golf ball after impact by the putter. To make such a club, the first material 225 (engineered stone or concrete) may be mixed and poured into a mold with a shape corresponding to a perimeter-weighted mallet putter head.

Due to the cold-molding process, other features and components may be added during molding. For example, the first material 225 may be molded into a body member 251. Additionally or alternatively, one or more weight inserts 905 may be disposed within the first material 925 during molding. Further, features such as a hosel, or a shaft attachment point, or a device such as an electronic device, or a mounting point for an electronic device, may be added to the first material 225 during molding.

Use of the described materials provides a number of beneficial advantages. The described materials are easy to work with and cast or mold. The described materials simplify the molding process due to room-temperature casting, aka cold molding. The described materials provide a drastic reduction in tooling costs compared to molding hot-mold materials. It is easy to supplement construction with additional materials such as low or high density fillers, etc. The described materials and their ingredients are abundant, solid, durable, inexpensive, have low density, can be dyed/stained, and are sustainable.

Moreover, the use of high-pozzolan concrete gives great shape flexibility. Molds are easy to create and (e.g., due to cold-molding) can be made of available materials such as resin, wood, metal, rapid prototyping material, etc. Almost any shape can be cast or molded, and the process leaves great flexibility for hosel attachment.

The described materials are receptive to custom finishes and personalization. They can be dyed or stained in any color or poly-dipped for particular finishes and for protection. The described materials allow for control over material density. The described materials can be created in layers with a continuum of densities. This allows one to make a putter with, for example, a high COG for good spin characteristics. Density can be controlled by including highly dense material such as metal (e.g., Tungsten) plugs, powders, or shavings. Concrete and engineered stone allow for honed surface that can be made flat, very accurately. Materials can be combined, extruded, or other materials or parts can be molded in or attached by co-molding.

Things that can be molded into the described materials include material such as brass or copper (which offer attractive patinas), rebar, or other reinforcing materials. Since there is flexibility in what the mold can be, one can rapid-prototype 3D molds for custom putters or other club heads or golf club components. The concrete or engineered stone component may be coated, e.g., with polyurethane, epoxy, TPU film, a dip, a sealant, dye, pigment, etc. For additional background see U.S. Pat. No. 9,132,324; U.S. Pub. 2016/0001139; JP Pat 3055886 B2; and a machine translation of JP Pat 3055886 B2 available through the espacenet website, the contents of each of which are incorporated by reference.

Figure 11:
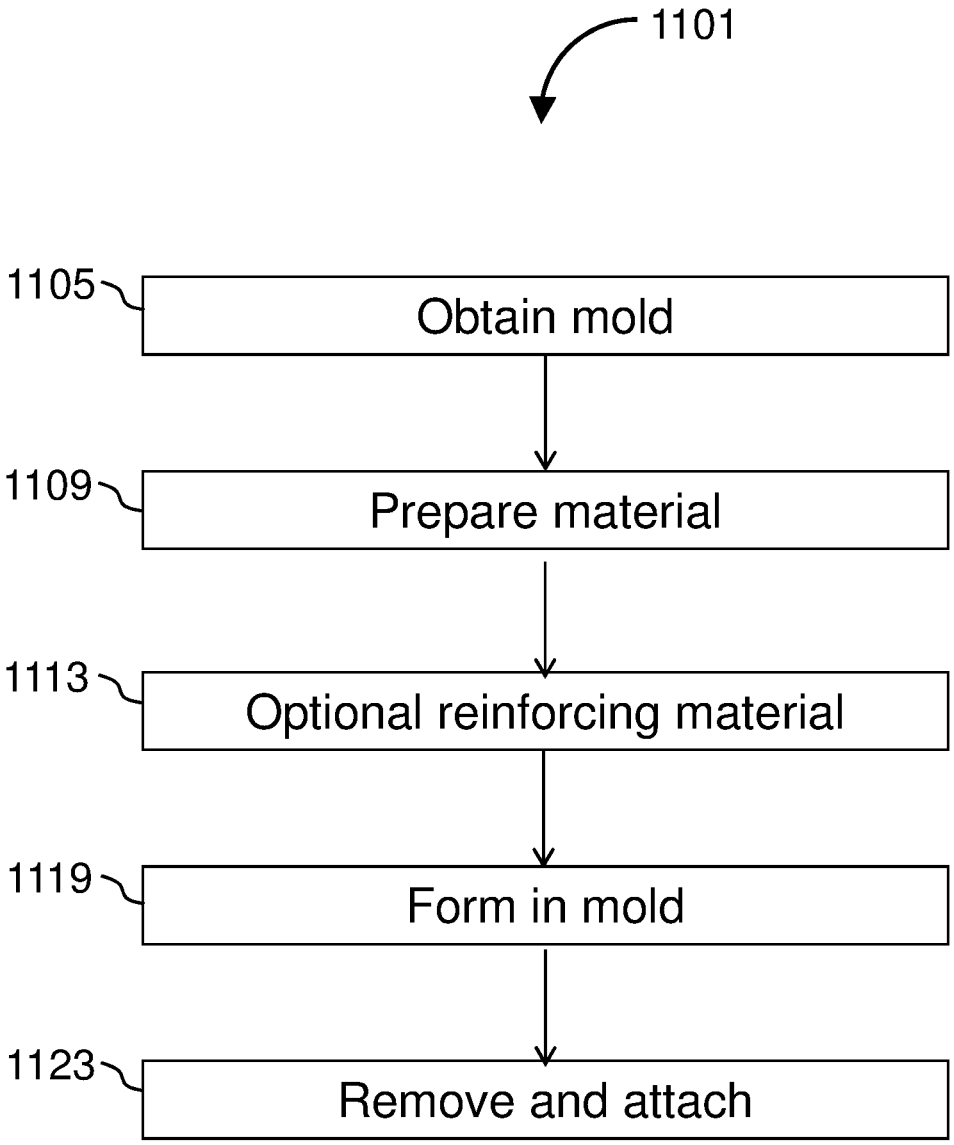
FIG. 11 shows a method of making a component for a golf club.

FIG. 11 shows a method 1101 of making a component for a golf club. The method 1101 includes obtaining 1105 a mold for the component. A first material 225 is prepared 1109. The first material 225 preferably includes concrete or engineered stone. Where the first material 225 is engineered stone, the first material 225 may be prepared 1109 by mixing about 93% stone aggregates with about 7% polyester resin, or any other suitable composition for engineered stone. Where the first material 225 is concrete, the first material 225 is prepared 1109 by mixing less than about 60% Portland cement with at least about 40% pozzolan, as well as optionally any of the reinforcing materials described herein. Optionally, a reinforcing material such as steel fibers, composite fibers, or plastic fibers is added 113 to the prepared 1109 material. The first material 225 is formed 1119 in a mold. Once it is set, the component is removed 1123 from the mold to be attached to the other components of a golf club head. In the related embodiment of the method 1101, part of the mold is provided by a second portion of the club head. For example, a body member 251 (such as a cast steel or Ti club head shell) is obtained, and is used to mold the first component from the first material 225.

Figure 12:
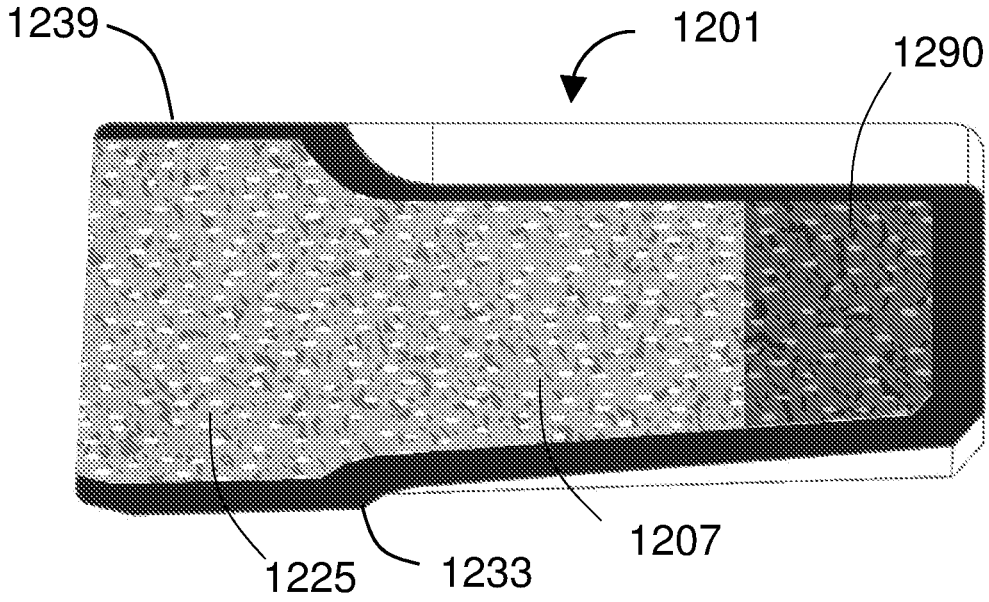
FIG. 12 shows another embodiment of a golf club head.
Figure 13:
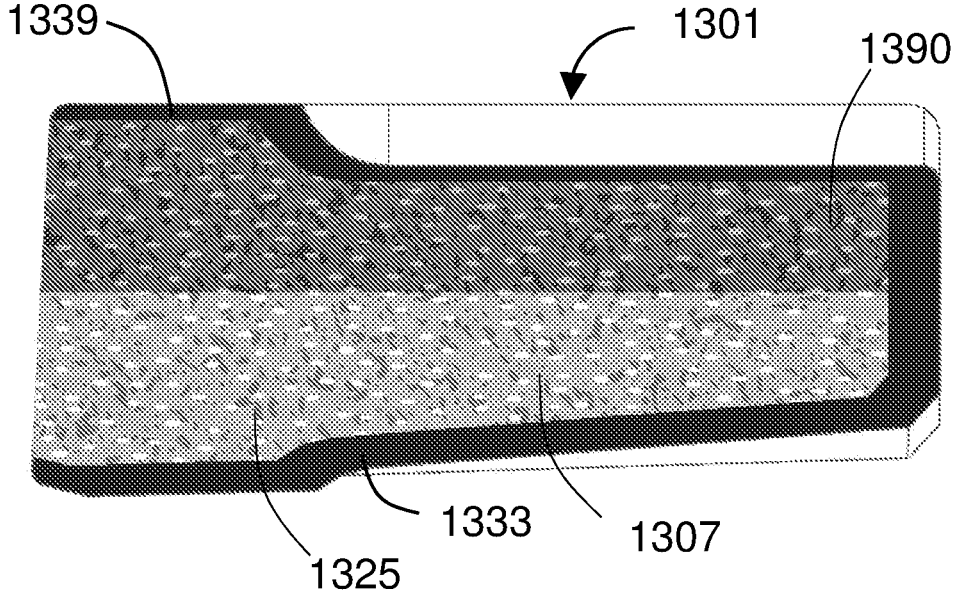
FIG. 13 shows another embodiment of a golf club head.

FIGS. 12 and 13 show other embodiments of a golf club head consistent with the present disclosure and including multi-material construction including variable density. For example, FIG. 12 shows one embodiment of a golf club head 1201 with a multi-material construction in which at least a first portion 1207 of the club head 1201 is made of a first material 1225 such as engineered stone or concrete and another portion 1233 of the head is made of a second material 1239 such as a metal, thermoplastic, or composite. FIG. 13 shows one embodiment of a golf club head 1301 with a multi-material construction in which at least a first portion 1307 of the club head 1301 is made of a first material 1325 such as engineered stone or concrete and another portion 1333 of the head is made of a second material 1339 such as a metal, thermoplastic, or composite.

As shown in both FIGS. 12 and 13, the areas of different color represent areas of different density within the club heads 1201 and 1301. That is, darker areas are areas where the first material 1225, 1325 (e.g., the engineered stone or concrete) is impregnated with a denser material 1290, 1390, such as Tungsten, thereby providing the golf club head with variable density.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

I claim:

1. A golf club head, the club head comprising:

a heel portion, a toe portion, and a ball-striking face; and a hosel extending upward from the heel portion when the club head is at address, wherein the club head has a multi-material construction in which a first portion of the club head is made of a first material that makes up about 20 and 80 percent of a volume of the club head and includes concrete or engineered stone comprising crushed stone bound together by an adhesive, and a second portion of the club head is made of a second material different from the first material.

2. The club head of claim 1, wherein the second portion is a body member providing at least a portion of an outer surface of the club head, and the first material is disposed within the body member.

3. The club head of claim 2, wherein the body member is a metal casting and further wherein the club head is made by a process that includes cold-molding the first material using the metal casting as a mold for the cold-molding.

4. The club head of claim 1, wherein the first material is concrete that comprises less than about 60% cement and at least about 40% pozzolan.

5. The club head of claim 4, wherein the cement comprises between about 60 and 66 percent by weight CaO and between about 18 and 23 percent by weight SiO2.

6. The club head of claim 1, wherein the first material further includes a reinforcing material disposed therein.

7. The club head of claim 6, wherein the reinforcing material comprises a lattice of struts.

8. The club head of claim 7, wherein the ball-striking face is provided by the first material and is surrounded by the body member made of the second material.

9. The club head of claim 8, wherein the first material is engineered stone that makes up between about 40 and 80 percent of the volume of the golf club head.

10. The club head of claim 9, wherein the body member is a metal casting.

11. The club head of claim 10, wherein the club head is made by a process that includes cold-molding the first material using the metal casting as a mold for the cold-molding.

12. The club head of claim 6, wherein the reinforcing material comprises fibers selected from the group consisting of steel fibers, composite fibers, and plastic fibers.

13. The club head of claim 6, wherein the reinforcing material comprises reclaimed waste.

* * * * *